US011612782B2

(12) United States Patent
Zanyk

(10) Patent No.: US 11,612,782 B2
(45) Date of Patent: Mar. 28, 2023

(54) EXERCISE APPARATUS

(71) Applicant: W2DESIGNS LLC, South Glastonbury, CT (US)

(72) Inventor: Marien J. Zanyk, South Glastonbury, CT (US)

( * ) Notice: Subject to any disclaimer, the term of this patent is extended or adjusted under 35 U.S.C. 154(b) by 244 days.

(21) Appl. No.: 16/640,674

(22) PCT Filed: Aug. 22, 2018

(86) PCT No.: PCT/US2018/047601
§ 371 (c)(1),
(2) Date: Feb. 20, 2020

(87) PCT Pub. No.: WO2019/040667
PCT Pub. Date: Feb. 28, 2019

(65) Prior Publication Data

US 2020/0353307 A1 Nov. 12, 2020

Related U.S. Application Data

(60) Provisional application No. 62/554,671, filed on Sep. 6, 2017, provisional application No. 62/548,523, filed on Aug. 22, 2017.

(51) Int. Cl.
*A63B 21/00* (2006.01)
*A63B 21/002* (2006.01)
(Continued)

(52) U.S. Cl.
CPC ..... *A63B 21/4037* (2015.10); *A63B 21/4034* (2015.10); *A63B 21/4035* (2015.10);
(Continued)

(58) Field of Classification Search
CPC ..... A63B 6/00; A63B 17/00; A63B 17/04; A63B 21/00047; A63B 21/0005;
(Continued)

(56) References Cited

U.S. PATENT DOCUMENTS 3,284,819 A * 11/1966 Nissen ..... A47C 27/001 404/35
3,319,273 A * 5/1967 Solin ..... A63B 6/00 473/29

(Continued)

OTHER PUBLICATIONS

"BedROK DEMO Video" (WILLOW WorkoutTM Freeform Exercise) Jul. 9, 2017 (Jul. 9, 2017) [online] retrieved from <URL: https://www.youtube.com/watch?=CFlgEYr1Kis> entire document, especially 0:07-0:22.

(Continued)

*Primary Examiner* — Gary D Urbiel Goldner
(74) *Attorney, Agent, or Firm* — Lathrop GPM LLP; William T. Griffith

(57) ABSTRACT

The present disclosure provides an exercise apparatus with a mobility mat and an orthopedic device. The mobility mat can have a plurality of segments with a plurality of assistive features such as hand holds, foot holds, and a contoured cushion. The mobility mat can be configured to couple with the orthopedic device. The orthopedic device can have an inclined face and a plurality of remaining faces including various additional assistive features.

12 Claims, 11 Drawing Sheets

(51) Int. Cl.
*A63B 21/04* (2006.01)
*A63B 23/12* (2006.01)

(52) U.S. Cl.
CPC ..... *A63B 21/4039* (2015.10); *A63B 21/002* (2013.01); *A63B 21/0442* (2013.01); *A63B 23/1236* (2013.01); *A63B 2209/00* (2013.01); *A63B 2209/08* (2013.01); *A63B 2209/10* (2013.01); *A63B 2210/50* (2013.01)

(58) Field of Classification Search
CPC ..... A63B 21/00054; A63B 21/00185; A63B 21/002; A63B 21/0023; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0555; A63B 21/0557; A63B 21/068; A63B 21/4023; A63B 21/4027; A63B 21/4033; A63B 21/4034; A63B 21/4035; A63B 21/4037; A63B 21/4039; A63B 23/12; A63B 23/1209; A63B 23/1236; A63B 26/00; A63B 26/003; A63B 71/0036; A63B 2208/02; A63B 2208/0204; A63B 2208/0209; A63B 2208/0214; A63B 2208/0219; A63B 2208/0223; A63B 2208/0228; A63B 2208/0238; A63B 2208/0242; A63B 2208/0247; A63B 2208/0252; A63B 2208/0257; A63B 2208/0261; A63B 2208/0266; A63B 2208/0271; A63B 2208/028; A63B 2208/0295; A63B 2209/00; A63B 2209/08; A63B 2209/10; A63B 2210/00; A63B 2210/50; A63B 2210/52; A63B 2210/54; A63B 2225/09; A63B 2225/093
See application file for complete search history.

(56) References Cited

U.S. PATENT DOCUMENTS 4,210,322 A * 7/1980 Pritchard ..... A63B 21/4029 482/142
4,575,369 A * 3/1986 Grayek ..... A45C 9/00 493/267
4,905,990 A * 3/1990 DeSantis ..... A63B 6/00 482/148
4,987,625 A * 1/1991 Edelson ..... A47C 20/026 D12/128
5,066,001 A * 11/1991 Wilkinson ..... A63B 21/4037 482/52
5,100,130 A 3/1992 Shoebrooks
5,370,460 A * 12/1994 Nelson ..... A45F 4/02 383/4
5,417,636 A * 5/1995 Havens ..... A63B 21/0552 482/145
5,551,934 A * 9/1996 Binette ..... A63B 21/4037 482/130
5,584,786 A * 12/1996 Almeda ..... A63B 23/0211 482/142
5,722,923 A 3/1998 Lui
5,941,638 A * 8/1999 Fonseca ..... A47G 9/062 5/419
6,322,485 B1 * 11/2001 Marrero ..... A63B 21/4037 482/142
6,623,270 B1 * 9/2003 Meldeau ..... A63B 21/4039 432/140
6,648,838 B1 * 11/2003 Brandon ..... B60N 2/66 128/845
6,751,816 B1 * 6/2004 Wechsler ..... A47G 9/062 383/4
7,207,932 B1 * 4/2007 Dean ..... A63B 23/0211 482/148
7,452,313 B2 * 11/2008 Endelman ..... A63B 21/4037 482/142
7,520,846 B1 * 4/2009 Manuel ..... A63B 21/151 482/142
8,037,561 B2 * 10/2011 Austwick ..... A47D 5/00 5/655
8,075,464 B2 * 12/2011 Hayes ..... A63B 21/4037 5/127
8,296,881 B2 * 10/2012 Litman ..... A63H 33/003 5/655
RE43,981 E * 2/2013 Endelman ..... A63B 21/00047 482/121
8,631,833 B2 1/2014 Garbarino
8,632,443 B2 * 1/2014 Hauptmann ..... A63B 21/4037 482/121
9,295,337 B1 * 3/2016 Bavli ..... B64D 11/00
9,545,537 B2 * 1/2017 Savioli ..... A63B 21/16
9,964,254 B1 * 5/2018 Hayes ..... F41A 23/16
10,342,321 B1 * 7/2019 Le ..... A47G 9/062
2005/0192158 A1 * 9/2005 Edwards ..... A63B 6/00 482/148
2007/0275827 A1 * 11/2007 Glaser ..... A63B 21/4037 482/148
2008/0058165 A1 * 3/2008 Schletti ..... A63B 21/4037 482/23
2008/0118671 A1 * 5/2008 Bienkiewicz ..... A63B 21/4037 428/12
2009/0260157 A1 * 10/2009 Gere ..... A45C 9/00 5/417
2010/0016134 A1 * 1/2010 Reese ..... A63B 21/4013 482/131
2010/0115698 A1 * 5/2010 Litman ..... A63H 33/003 5/420
2010/0143645 A1 * 6/2010 Wilmsen ..... F26B 5/16 428/116
2010/0197471 A1 * 8/2010 Hayes ..... A63B 23/0211 482/142
2010/0267532 A1 * 10/2010 Newburger ..... A63B 23/0216 482/142
2012/0233772 A1 * 9/2012 Wang ..... A63B 21/4037 5/417
2013/0180046 A1 7/2013 Davis
2013/0324382 A1 12/2013 Wilson
2014/0101848 A1 * 4/2014 Murphy ..... A47G 9/062 5/420
2014/0242357 A1 * 8/2014 Morris ..... A63B 21/4037 428/196
2014/0342118 A1 * 11/2014 Connaughton ..... A63B 6/00 428/218
2015/0143631 A1 5/2015 Fleming
2016/0129299 A1 * 5/2016 Newman ..... A63B 21/4037 482/142
2017/0291055 A1 * 10/2017 Madion ..... A63B 21/00047
2018/0028853 A1 * 2/2018 Cargill ..... A63B 21/00047
2018/0243166 A1 * 8/2018 Splichal ..... A61H 39/00

OTHER PUBLICATIONS

International Search Report in International Patent Application No. PCT/US2018/047601, dated Nov. 21, 2018 (9 pages).

* cited by examiner

EXERCISE APPARATUS

CROSS-REFERENCE TO RELATED APPLICATIONS

This application is a U.S. National Stage of International Application No. PCT/US2018/047601, filed Aug. 22, 2018, which claims the benefit of and priority to U.S. Provisional Application No. 62/548,523, filed Aug. 22, 2017, and U.S. Provisional Application No. 62/554,671, filed Sep. 6, 2017, each of which is hereby incorporated by reference herein in their entireties.

FIELD OF THE INVENTION

The present invention relates to exercise apparatus, and, more specifically, to exercise apparatus comprising a mobility mat and attachable orthopedic device.

BACKGROUND OF THE INVENTION

The fitness industry has grown significantly as society increasingly recognizes the relationship between health and fitness. In order to stay healthy, people need a pain-free way to exercise. Freestyle fitness equipment has grown in popularity as consumers desire exercise equipment that can be easily transported, used in locations other than a gym, and used without an instructor. However, existing exercise apparatus can be outdated, expensive, and with limited or ineffective applications.

For example, existing yoga mats provide a basic structure upon which to perform free-standing exercises. However, existing yoga mats generally lack any assistive features that can help a user perform progressive chains of movement to match natural positions. The lack of additional features of existing yoga mats limits a user's exercise routine to unassisted movement. A user is more likely to be injured during unassisted movements due to instability and improper joint and muscle load as the user struggles to maintain proper balance. A user's knees and ankles are particularly at risk.

Furthermore, a user can risk additional injury if the user attempts to supplement the unassisted movements with heavy metal weights. Heavy metal weights do not allow variety of force for the appropriate joint and soft tissue group. This risks additional injury because the user may not even be able to determine the appropriate force. Additionally, unassisted movements do not enable progressive, controlled positions for targeted tissue recovery through chains of movement.

Assistive features can help users explore a wider range of movements, achieve greater versatility in limb positions, rehabilitate injured joints and/or muscles, target specific body parts, combinations thereof, or the like.

Therefore, it would be desirable to have freestyle fitness equipment that can address the deficiencies described above and/or meet the fitness and rehabilitative needs of consumers.

SUMMARY OF THE INVENTION

The various examples of the present disclosure are directed towards exercise apparatus. A first embodiment of the present disclosure can provide for a mobility mat. The mobility mat can have a plurality of segments with a top surface and a bottom surface. The first surface can be a top surface of the mat and the second surface can be a bottom surface of the mat. The mobility mat can also have a plurality of segments. A first segment can include a cushion and at least one hand hold. A second segment can be positioned opposite the first segment and include at least one hand hold and at least one foot hold. The plurality of segments can also include at least one middle segment positioned between the first and second segment. The middle segment can include at least one hand hold.

A second embodiment of the present disclosure can provide for an orthopedic device. The orthopedic device can have a plurality of sides. A first side can have an inclined portion. A second side can have a two-tiered ledge. Opposing side portions can bridge the first side and the second side. Each of the opposing side portions can include a generally rounded hand grip and a generally flat hand grip. The orthopedic device can further include a contoured top side.

The mobility mat and the orthopedic device can be as explained previously. For example, the mobility mat can have a plurality of segments, a top surface, and a bottom surface, as described previously. In the third embodiment, the mobility mat can also have at least one first connector. The orthopedic device can include a plurality of sides with various features as described previously. In the third embodiment, the orthopedic device can also include at least one second connector. The at least one second connector can be configured to receive the at least one first connector of the mobility mat.

BRIEF DESCRIPTION OF THE DRAWINGS

The accompanying drawings exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements and are not drawn to scale.

DETAILED DESCRIPTION

Figure 1:
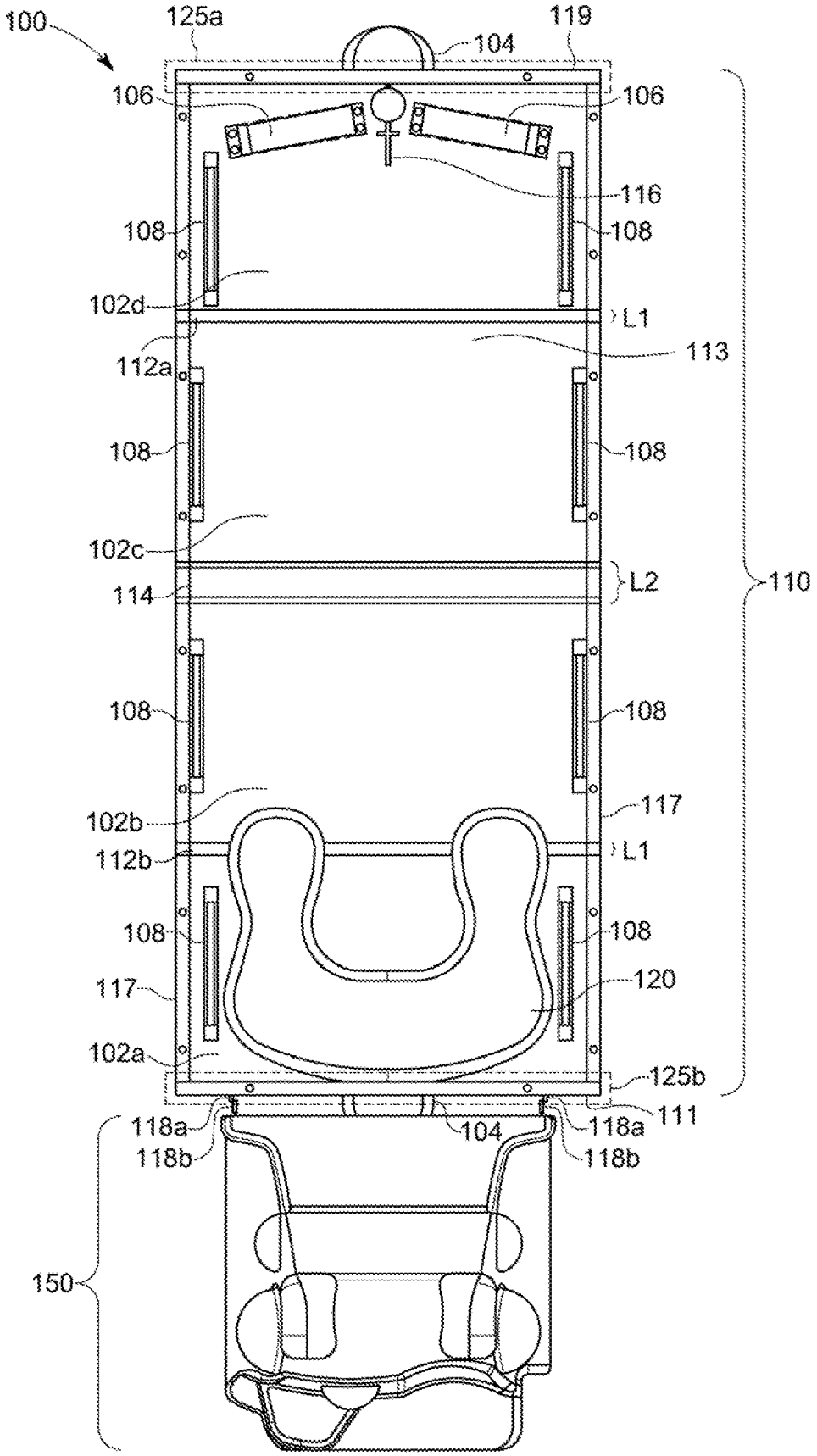
FIG. 1 shows a schematic diagram of a top surface of an exemplary exercise apparatus, according to an embodiment of the present disclosure.

The present invention is described with reference to the attached figures, where like reference numerals are used throughout the figures to designate similar or equivalent elements. The figures are not drawn to scale and are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The present disclosure is directed to an exercise apparatus that includes a mobility mat, which may optionally include an orthopedic device. The mobility mat can have a plurality of segments with a plurality of assistive features such as hand holds, foot holds, and/or a contoured cushion. The mobility mat can be configured to couple with the orthopedic device. The orthopedic device can have an inclined face and a plurality of remaining faces including various additional assistive features, as will be described in more detail below. These assistive features allow a user interact therewith to target specific body parts, rehabilitate from injury, and/or achieve a wide variety in exercises with a single piece of integrated equipment. Non-limiting additional benefits of the various assistive features are discussed through the present disclosure with respect to each of the features.

FIG. 1 shows a schematic diagram of an exemplary exercise apparatus 100, according to an embodiment of the present disclosure. For example, apparatus 100 includes a mobility mat 110 and an optional orthopedic device 150 that may be coupled thereto. The mobility mat 110 includes a plurality of segments 102*a*, 102*b*, 102*c*, and 102*d*, handles 104, foot holds 106, hand holds 108, connecting segments 112 and 114, receiving element 116, optional connectors 118, and a cushion 120. FIG. 1 shows how the mobility mat 110 can be coupled with the orthopedic device 150 via the connectors 118 to provide an exercise apparatus with a variety of exercise features.

The connectors 118 include a first at least one connector 118*a* positioned at a first end 111 of the mobility mat 110 and a second at least one connector 118*b* positioned on a portion of the orthopedic device 150 configured to be adjacent to the first end of the mobility mat 110. The first and second connectors 118*a*, 118*b* are configured to mate with one another such that the orthopedic device 150 may be coupled to the mobility mat 110. It is contemplated that any suitable type of connectors 118 may be used including, for example, hooks, snaps, hook-and-loop type fasteners, male and female connectors, adhesive elements, magnets, or any other material, any combination thereof, or the like.

The orthopedic device 150 will be discussed further with respect to FIGS. 8A-8D. Example exercise techniques involving both orthopedic device 150 and mobility mat 110 will be discussed later with respect to FIGS. 9A-9D.

In the non-limiting embodiment of FIG. 1, the mobility mat 110 includes four segments: a top segment 102*a*, a second segment 102*b*, a third segment 102*c*, and a bottom segment 102*d*. Although four segments 102 are shown in FIG. 1, any suitable number of segments 102 can be included. The four segments 102*a*, 102*b*, 102*c*, and 102*d* shown in FIG. 1 are generally rectangular in shape and can provide a cumulative length approximately equal to the average height of a person. For example, the tour segments 102*a*, 102*b*, 102*c*, and 102*d* can have a cumulative length of 74 inches. Each segment can have a width of 30.5 inches and a depth of approximately one inch. Although the four segments 102*a*, 102*b*, 102*c*, and 102*d* are shown in FIG. 1 to be approximately uniform in length, each segment can have a unique length. For example, the top and bottom segments 102*a*, 102*d* can have a length of 17.75 inches while second and third segments 102*b*, 102*c* have a length of 19.25 inches. In some embodiments, the widths of each segment are generally the same in general, the rectangular shape and size of the plurality of segments 102*a*, 102*b*, 102*c*, and 102*d* can enable a variety of exercise positions along the length and width of the mat. The plurality of segments 102*a*, 102*b*, 102*c*, and 102*d* can provide cushioning to a user's head, torso, and limbs as the user moves through desired exercise positions.

The four segments 102*a*, 102*b*, 102*c*, and 102*d* can be each made of a plurality of layers or a single layer such that the segments 102*a*, 102*b*, 102*c*, and 102*d* provide cushioning between a user and the floor. It is contemplated that each of the four segments 102*a*, 102*b*, 102*c*, 102*d* may be made of the same or different materials or combinations of materials. For example, segments 102*a*, 102*b*, 102*c*, and 102*d* can be constructed of foam, rubber, yoga mat material, naugahyde, leather, vinyl, any other protective material, and any combinations thereof or similar materials.

The top and second segment 102*a*, 102*b* and the third and bottom segments 102*c*, 102*d* can be coupled to each other via connecting segments 112*a*, 112*b*. The second and third segments 102*b* and 102*c* can be coupled to each other via a generally central connecting segment 114. Connecting segments 112*a*, 112*b*, 114 can be comprised of a material that is generally thinner than the segments 102*a*, 102*b*, 102*c*, and 102*d*. Connecting segments 112*a*, 112*b*, and 114 can be generally flat, thin, and flexible. In some embodiments, the connecting segments112*a*, 112*b* have a length L1 generally equal to a depth D1 (see FIG. 2B) of one of the segments 102*a*, 102*b*, 102*c*, or 102*d*. In some embodiments, the generally central connecting section 114 has a length L2 that is generally twice as long as the length L1 of the connecting segments 112*a*, 112*b*. Such measurements assist the mobility mat 110 to fold neatly so that the four segments 102*a*, 102*b*, 102*c*, and 102*d* lie generally flush against one another when the mobility mat 110 is in a folded position. This is discussed further with respect to FIGS. 7A-7C.

Referring back to FIG. 1, the mobility mat 110 can have one or more foot holds 106 and hand holds 108. Although the foot holds 106 and hand holds 108 are referred to herein to indicate the use of a particular limb, both sets of holds 106, 108 can be used by any limb of the user, i.e, the user may use the foot and hand holds 106, 108 interchangeably, depending, for example, or the type of exercise, position, or stretch that is being performed. For example, a user can grasp the foot hold 106 with his or her hand or anchor his or her foot between the hand hold 108 and the top surface 113 of the mobility mat 110.

As shown in FIG. 1, each segment 102*a*, 102*b*, 102*c*, and 102*d* can include at least one hand hold 108. In a particular configuration of the present disclosure, each segment 102*a*, 102*b*, 102*c*, and 102*d* includes two hand holds 108, wherein each hand hold is positioned on an opposing side of the respective segment at or near the edge of the mobility mat 110. Additionally, the bottom segment 102*d* as shown in FIG. 1 can include the one or more (e.g., two) foot holds 106. The opposing ends of the foot holds 106 and hand holds 108 are generally coupled to the top surface 113 of the mobility mat 110, thereby forming an aperture between the respective foothand hold 106, 108 and the top surface 113 of the mobility mat 110 such that a human hand or foot may be received by the aperture. The foot holds 106 and/or hand holds 108 thereby assist in anchoring the user to the mobility mat 110 such that the user can position his or her body in various exercise positions on the mobility mat 110. Additionally, the sets of consecutive hand holds 108 along the sides of mobility mat 110 allow a user to move through various hand holds 108 to encourage progressive physical movement at different angles. This can be especially beneficial for therapeutic and orthotic recoveries. Particular shapes of hand holds 108 and foot holds 106 are discussed in more detail below with respect to FIGS. 4-5.

In the embodiment of FIG. 1, the hand holds 108 are positioned at varying distances from the edge 117 of the mobility mat 110. For example, the hand holds 108 on the top and bottom segments 102*a*, 102*d* are farther inset into an interior portion of the mobility mat 110 than the hand holds 108 on the second and third segments 102*b*, 102*c* of the mobility mat. For example, the hand holds 108 can vary from between 0.5-4 inches from the edge 117 of the mobility mat 110. Such a configuration allows the respective hand holds 108 to lie adjacent to each other, without overlapping, when the mobility mat 110 is in a folded position such that a compact, generally slim folded position may be obtained.

The mobility mat 110 can further include handles 104 positioned at generally opposite ends 111, 119 thereof. The handles 104 may be positioned along the opposing edges 111, near the opposing edges 111 on a back side of the mobility mat 110, or the like (discussed further with respect to FIG. 2A). The handles 104 can be used to easily move mobility mat 110 when mobility mat 110 is stretched out on a surface or to carry the mobility mat 110 when it is in a folded position (see FIG. 7C).

In the illustrated embodiments, the mobility mat 110 additionally includes a cushion 120. The cushion 120 can provide additional padding for a user when the user exercises on the mobility mat 110. For example, the cushion 120 can be positioned on the top segment 102*a* so that the cushion 120 may be adjacent to the orthopedic device 150. The cushion 120 can provide additional padding as a seat when the user interacts with the orthopedic device 150. In some examples, the cushion 120 can provide padding for a user's shin, a user's forearm, or a user's head and neck during various exercises. In some examples, cushion 120 can be removably attached (using, e.g., hook-and-loop type fasteners or any suitable attaching feature or combination of attaching features) from mobility mat 110. Removably attaching the cushion 120 may be desirable for ease of laundering or replacement. The cushion 120 features are discussed in more detail below with respect to FIGS. 3A-3B.

Referring back to FIG. 1, the mobility mat 110 may also include a receiving element 116. Although receiving element 116 of FIG. 1 is coupled to the bottom segment 102*d*, the receiving element 116 can be located in any of the plurality of segments 102*a*, 102*b*, 102*c*, and 102*d*. The receiving element 116 can be configured to receive a supplemental exercise device such as an exercise hand, resistance band, or any other standalone exercise element. Receiving element is discussed further with respect to FIG. 4.

Referring back to FIG. 1, the mobility mat 110 can additionally include a counterbalancing weight (not pictured) in location 125*a* and 125*b*. The counterbalancing weight can serve to provide extra weight to the mobility mat 110 such that ends of the mobility mat 111, and 119 are not pulled up or shifted when a user is performing pushups or sit-ups.

Although the figures of the present application show a particular configuration of the assistive features of an exemplary mobility mat, a person skilled in the art would understand that an exemplary mobility mat, according to embodiments of the present disclosure, can have more or less assistive features. For example, although the mobility mat 110 of FIG. 1 includes eight hand holds 108 and two foot holds 106, there can be more or less of either the hand holds 108 or foot holds 106. Additionally, the assistive features can have different arrangements than as shown in the present disclosure, so long as the assistive features are configured to be engaged by a user.

Figure 2A:
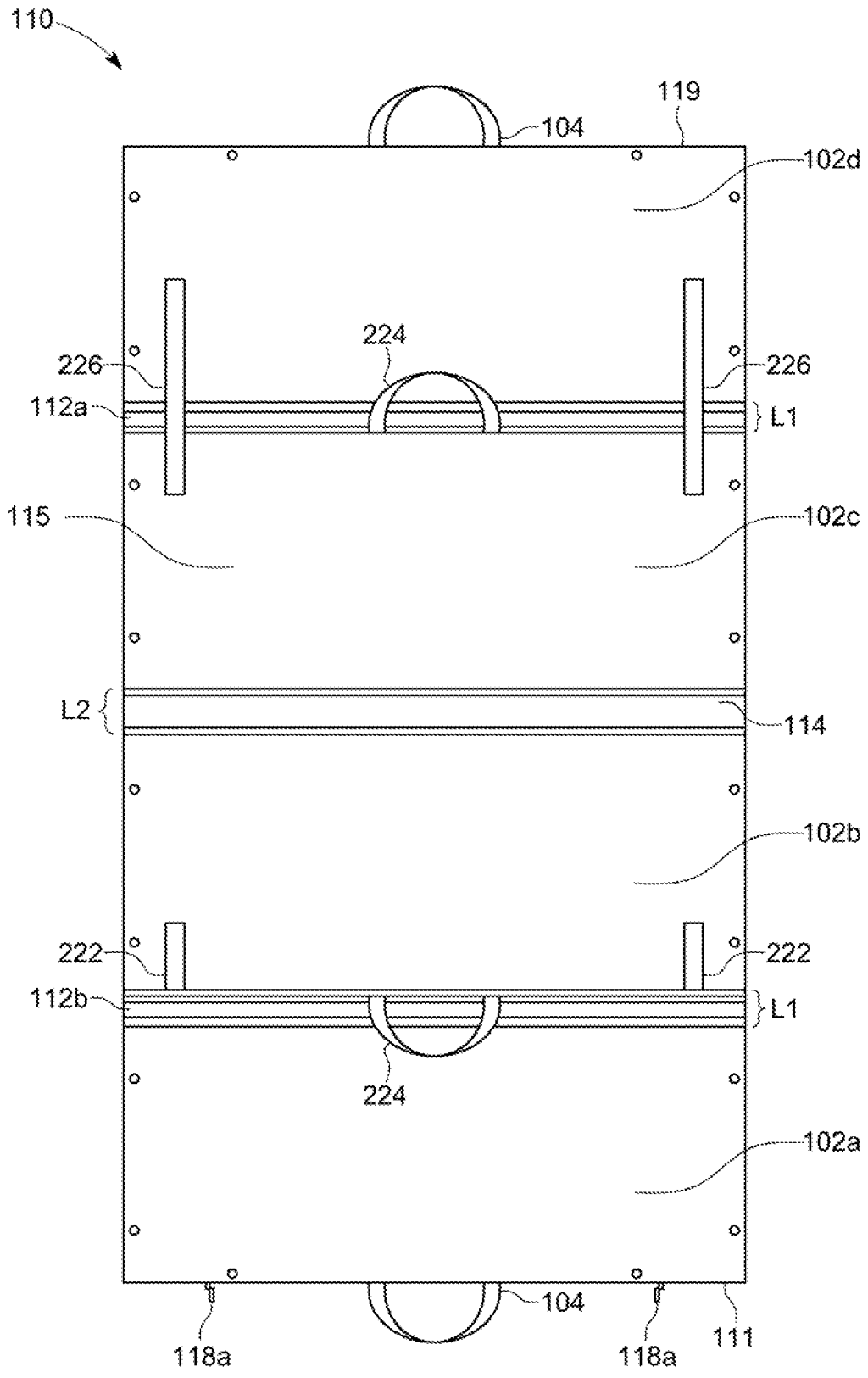
FIG. 2A shows a bottom portion of an exemplary mobility mat, according to an embodiment of the present disclosure.

FIG. 2A shows a bottom side 115 of an exemplary mobility mat 110, according to an embodiment of the present disclosure. The mobility mat 110 of FIG. 2A includes similar elements with the same numbering and functions as the elements of FIG. 1. Additionally, FIG. 2A shows first coupling elements 222, bottom handles 224, and second coupling elements 226. The first coupling elements 222 and the second coupling element 226 are configured to mate with one another such that each of the first coupling elements 222 can couple with a respective one of the second coupling elements 226 when in contact therewith. For example, coupling elements 222 and 226 can be hooks, snaps, hook-and-loop type fasteners, male and female connectors, adhesive elements, magnets, or any other material, any combination thereof, or the like, or element (or combination thereof) that generally securely fastens. Coupling elements 222 and 226 can contact with each other when mobility mat 110 is in a folded position in order to assist in securing the mobility mat 110 in the folded position (see FIG. 7C). Additionally, the bottom handles 224 are generally positioned so they can be used to carry mobility mat 110 when mobility mat 110 is in a folded position.

Figure 2B:
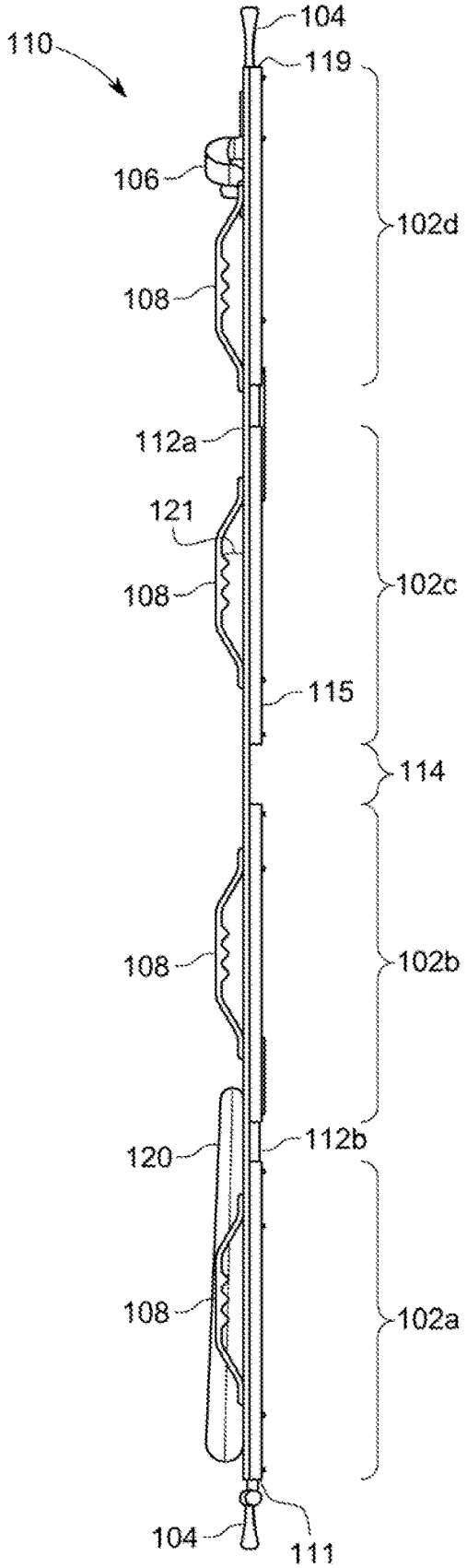
FIG. 2B shows a side view of an exemplary mobility mat, according to an embodiment of the present disclosure.

FIG. 2B shows a side view of an exemplary mobility mat 110, according to an embodiment of the present disclosure. FIG. 2B includes similar elements with the same numbering and same functions as elements of FIGS. 1-2A. FIG. 2B shows how specific assistive features extend away from the top surface 113 of the mobility mat 110, thereby forming an aperture 121 between the assistive feature(s) and the top surface 113 of the mobility mat 110. For example, hand holds 108 and foot holds 106 can be configured to extend away from mobility mat 110. The aperture 121 formed therebetween is useful in providing for easy anchoring of a body limb by a user during an exercise routine.

Figure 3A:
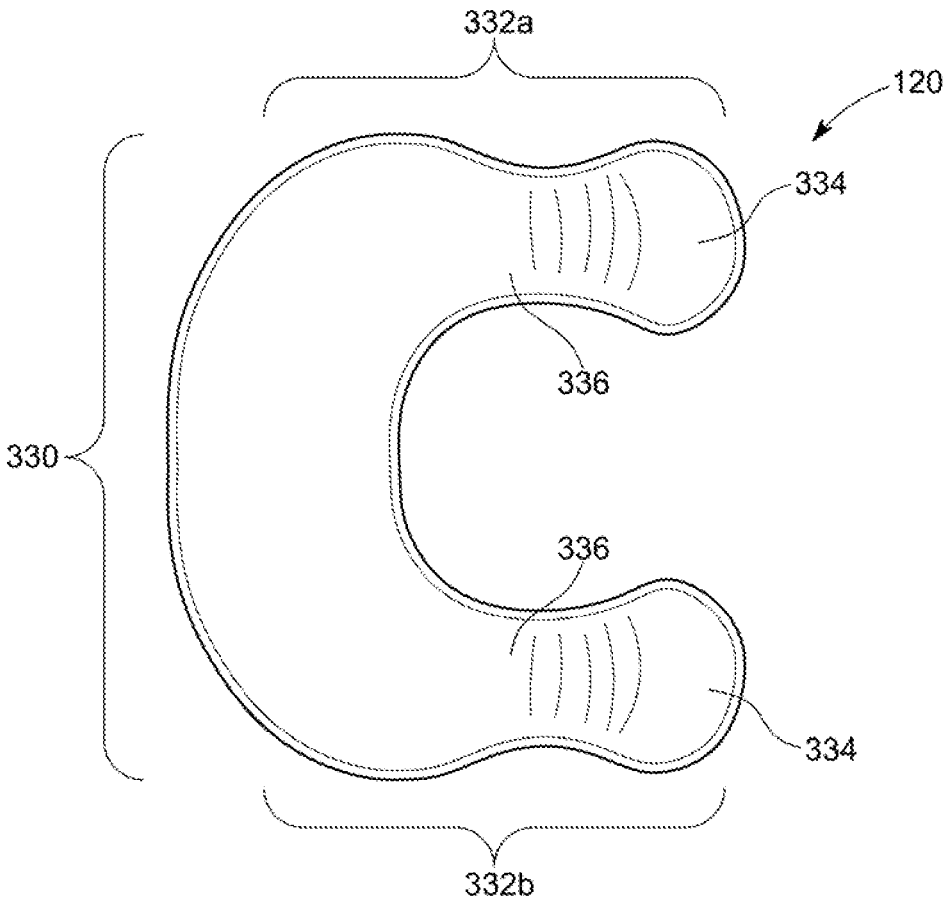
FIG. 3A shows a top view of an exemplary cushion, according to an embodiment of the present disclosure.
Figure 3B:
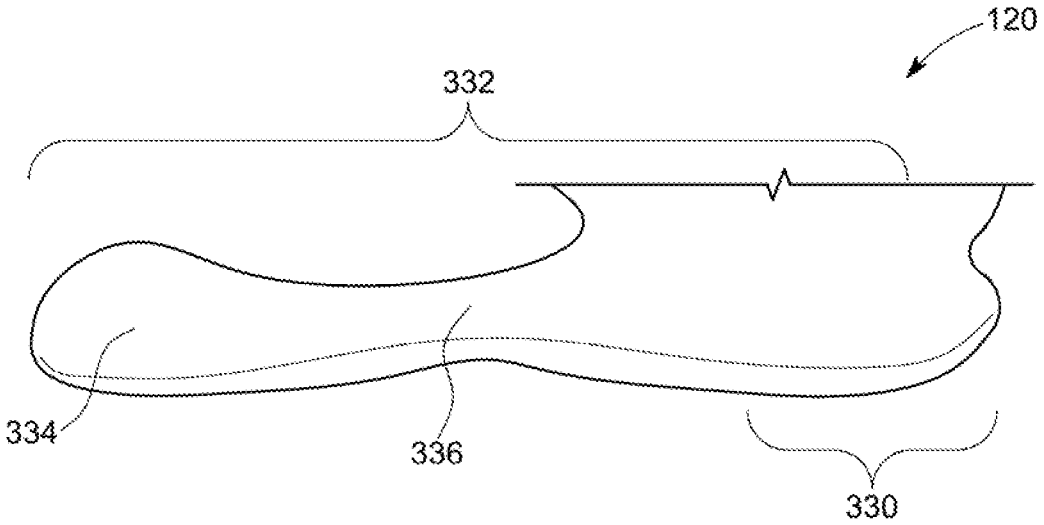
FIG. 3B shows a side view of an exemplary cushion, according to an embodiment of the present disclosure.

FIGS. 3A-3B show various perspective views of the exemplary cushion 120, according to one non-limiting embodiment of the present disclosure. The cushion 120 may include a base 330, a first extension 332*a*, a second extension 332*b*, a first portion 334*a*, a second portion 334*b*, and connector portions 336. The cushion 120 can be formed of any suitable material. It may be desirable for the cushion 120 to be formed of a compressible material(s) designed to cushion a user's weight. In one embodiment, the cushion 120 is formed of a foam or foam-like material having a cover thereon (not pictured). The cover can assist in preventing blisters when a user's skin repeatedly contacts the cushion 120 during exercise. Additionally, the cover can assist in wicking away a user's sweat. In some instances, the cover can be removable for ease of laundering, replacement, or interchangeability. As briefly discussed above, the cushion 120 itself can also be removable from the mobility mat 110.

In one non-limiting embodiment, the cushion 120 is shaped in a hollowed semi-circular shape with a base 330, a first extension 332*a* extending from a first side of the base 330 and a second extension 332*b* extending from the second side of the base. In some embodiments, each extension 332*a* and 332*b* includes an end portion 334*a* and 334*b* and connector portions 336. The end portions 334*a* and 334*b* can be wider than connector portions 336 bridging each respective end portion 334*a* and 334*b* and the base 330. Although an exemplary shape of the cushion 120 is shown in FIGS. 3A-3B, it is contemplated that any shape can be used so long as the cushion is configured to fit within the bottom segment 102*d* of the mobility mat 110. For example, the cushion 120 can be rectangular or circular in nature. The extensions 332*a* and 332*b* likewise can be of any suitable dimensions. For example, the extensions 332*a* and 332*b* can be similar to the length of a forearm of a user, or a length of the top segment 102*a* of the mobility mat 110. Similarly, the base 330 can be configured to extend substantially across the top segment 102*a* such that the first extension 332*a* extends generally parallel with a first edge 123 of the top segment 102*a* and the second extension 332*b* extends generally parallel with a second edge 125 of the top segment 102*a*.

In some examples, the first extension 332*a* and the second extension 332*b* can be in a teardrop shape where the end portions 334*a* and 334*b* are wider than the connector portions 336.

FIG. 3B further demonstrates one embodiment in which the cushion 120 has a contoured design to reduce stress on particular body parts. For example, a main portion of base 330 can have thicker padding than the connector portions 336. End portions of first extension 332*a* and second extension 332*b* can have thicker padding than non-central portions of first and second extension 332*a* and 332*b*.

The cushion 120 can provide padding to a user during exercises. For example, a user can place his forearm along the first extension 332*a* during a side plank. Thicker padding, along the base 330 and the teardrop end portion 334*a* assists in allowing the user to reduce stress on his or her wrist and/or elbow during the exercise. In other examples, the cushion 120 can be used as a seat or as padding while kneeling. In other examples, the area between the extensions 332*a* and 332*b* can be a cutout for a pelvic positioning. Therefore, the shape and padding of the cushion 120 can provide contouring which matches the human form and provides protection of a user's bones, joints, and limbs.

Figure 4:
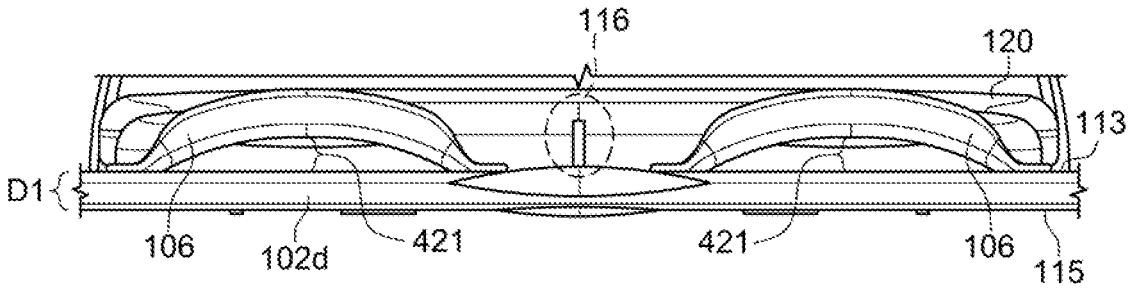
FIG. 4 shows a side view of an exemplary pair of foot holds, according to an embodiment of the present disclosure.

FIG. 4 shows a side view of an exemplary pair of foot holds, according to an embodiment of the present disclosure. FIG. 4 shows the foot holds 106, the receiving element 116, and the cushion 120. FIG. 4 demonstrates how the foot holds 106 can be configured to extend away from the top surface 113 of the bottom segment 102*d* of the mobility mat 110, at, e.g., a similar height to the padding of the cushion 120. Extending away from the mobility mat 110 at such a height assists in allowing the mobility mat 110 to neatly fold up with the segments being generally flush with one another when the mobility mat 110 is configured in a folded position (see FIG. 7C). Opposing ends of the foot holds 106 may be coupled to and extend from the mobility mat 110 such that the foot holds 106 are curved or in a convex shape, forming an aperture 421 between each of the foot holds 106 and the mobility mat 110. The apertures 421 are generally shaped to receive an insertion of a user's foot. Such an aperture 421 may receive a user's foot during exercise routines, for example.

Additionally, foot holds 106 can include a removable cover (not shown) which provides additional padding. This removable cover can prevent blistering or skin abrasions of a user's feet while anchoring to the foot holds 106.

FIG. 4 additionally shows a schematic representation of the receiving element 116. The receiving element 116 can be, for example, a j-hook, an s-hook, a clamp hook, a carabineer, or any other receiving element configured to optionally receive or be coupled with additional exercise equipment. For example, the additional exercise equipment can be an elastic exercise device or other resistance tool. In some examples, the receiving element 116 can have an overlay of fabric or padding, (not shown) to cover the receiving element 116 when not in use by the user. Such an overlay may assist in preventing injury to the user from unintentional contact with the receiving element 116.

Figure 5:
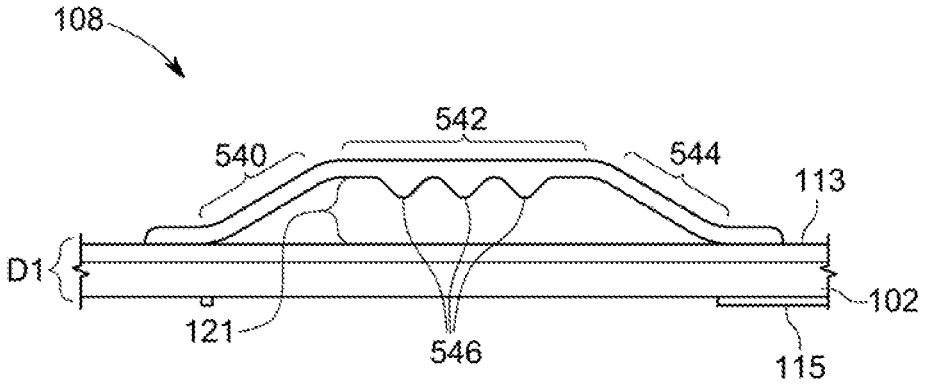
FIG. 5 shows a side view of an exemplary hand hold, according to an embodiment of the present disclosure.

FIG. 5 shows a side view of an exemplary hand hold 108 on any segment 102 of the mobility mat 110, according to an embodiment of the present disclosure. The hand hold 108 can include at first cud portion 540, a middle portion 542, a second end portion 544, and optional grips 546. A user can grasp the hand hold 108 during exercise routines while using the mobility mat 110, according to an embodiment of the present disclosure. Each portion 540, 542, and 544 has a unique angle from the user and can therefore exercise different aspects of the user's grip. Additionally, a user can progressively move through grasping each different portion 540, 542, and 544 while exercising. For example, a user can grasp the first end portion 540, then the middle portion 542, and finally the second end portion 544 during exercise. The three positions allow a user to gradually advance a hand stretch based on where the user places his or her hand. For example, when grasping first end portion 540, the user's hand can have an initial position where the hand soft tissues begin to relax, stretch, and elongate. When the hand soft tissues are sufficiently relaxed, the user can advance to middle portion 542 to increase the stretch. Finally, the user can advance to second end portion 544 to achieve a maximum stretch. Therefore, a hand hold 108, according to an embodiment of the present disclosure, can provide a progression of position choices.

The grips 546 can be structured to receive a user's fingers. These grips 546 can help the user have a more secure and/or comfortable grip on the hand hold 108.

Figure 6:
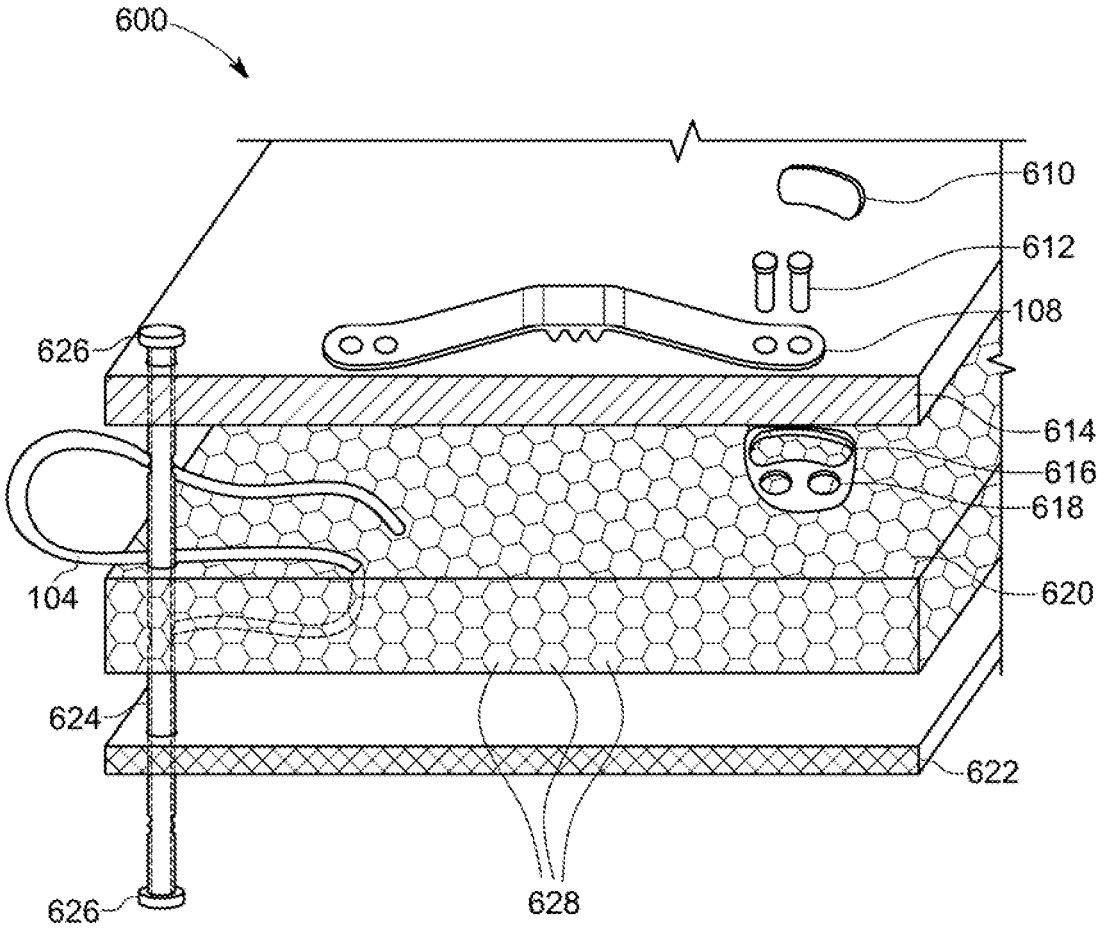
FIG. 6 shows an exploded view of the components of an exemplary mobility mat, according to an embodiment of the present disclosure.

FIG. 6 shows an exploded view of a system 600 including components of an exemplary mobility mat, according to an embodiment of the present disclosure. System 600 can include a handle finishing cap 610, one or more screws 612, a hand hold 108, a first layer 614, an anchor 616, one or more nuts 618, a second layer 620, a third layer 622, a binding post 624, one or more binding screws 626, and a honeycomb structure 628.

In the illustrated embodiment, the system 600 includes a plurality of layers, such as first layer 614, second layer 620, and third layer 622. Although three layers are shown in FIG. 6, it is contemplated that more or less layers can be used so long as the at least one layer is thick enough to provide a desired amount of cushioning for a user. The hand holds 108 (and foot holds 106, not shown in FIG. 6) can be attached to the mobility mat via a handle the screws 613, an anchor 616, and nuts 618. The screws 612 can attach the hand holds 108 to the first layer 614. A handle finishing cap 610 can be placed on top of the screws 613. The handle finishing cap 610 can protect a user from touching screws 612. The screws 612 can extend through the first layer 614 and receive a corresponding nut 618 and anchor 616. The anchor 616 may assist in anchoring the screws 612 and in reducing stress on first layer 614 resulting from the screws 612. The nuts 618 may also assist in keeping the screws 612 in place.

An exemplary first layer 614 can be a rubber yoga mat or any other padding element. The second layer 620 can be a honeycomb rubber mat, for example with a honeycomb structure 628 within the second layer 620. Such a honeycomb structure 628 can assist in reducing the weight of the mobility mat 110 while still providing adequate stability and support. Additionally, the honeycomb structures 628 can receive the handles 104 such that the handles 104 securely attach to and weave through honeycomb structures 628. Weaving through the honeycomb structures 628 allows the handles 104 to securely anchor to the second layer 620. In some embodiments, the second layer 620 can further include adhesive layer on one or both surfaces of to securely couple the first layer 614 to the second layer 620 and the second layer 620 to the third layer 622. The third layer 622 can include a finishing surface such as, for example, corrugated plastic.

FIG. 6 also shows binding posts 624 with binding screws 626. Binding posts 624 serve to provide additional stability for the mobility mat 110 in ensuring that the plurality of layers 610, 620, 622 stay attached. Although only one binding post 624 is pictured in FIG. 6, it is contemplated that binding posts 624 can be positioned at, e.g., edges of each segment of the mobility mat to further securely attach the various layers of the mobility mat. For example, a mobility mat can have about twenty binding posts 624 distributed throughout the edges of the layers of an exemplary mobility mat. Binding posts can have binding screws 626 within the binding post 624 to retain a position of the binding post 624.

Although an exemplary, non-limiting layering configuration is shown in FIG. 6, additional layering configurations are contemplated by the present disclosure. For example, foot holds 106 and hand holds 108 can be attached to any layer in the plurality of layers. The second layer 620 is not limited to a honeycomb configuration. In general, the plurality of layers can include a top cushion layer, an internal structural layer, and an inferior layer to anchor foot holds 106 and hand holds 108 and provide a protective covering for the internal structural layer. For example, the inferior layer can be made from a naugahyde material, a fabric coated with rubber or vinyl resin, or any combinations thereof or similar materials. Such a layering configuration provides structural support and padding for a user and protection and secure attachments for the assistive features.

Figure 7A:
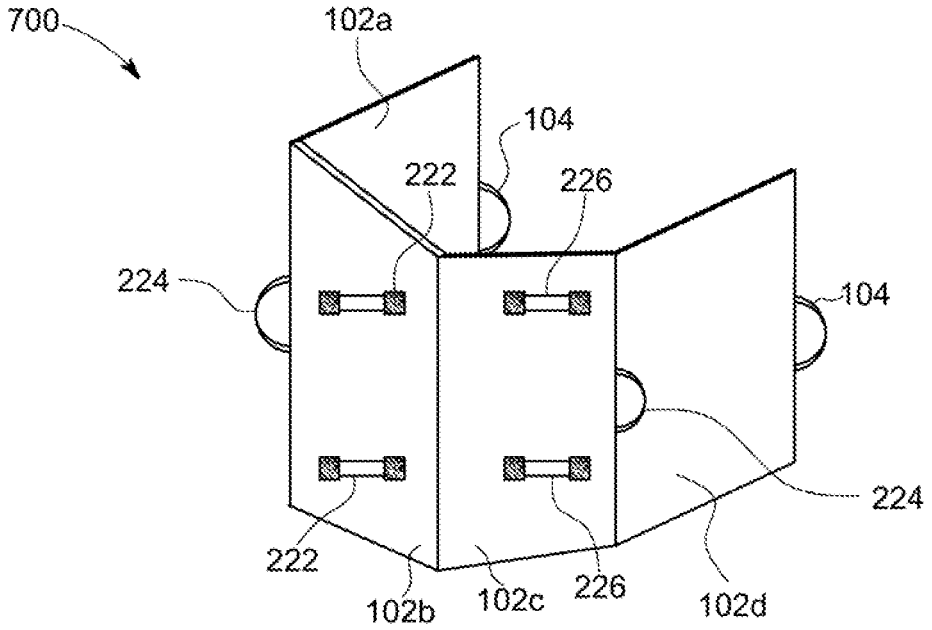
FIG. 7A shows an exemplary mobility mat as the mobility mat begins to fold, according to an embodiment of the present disclosure.
Figure 7B:
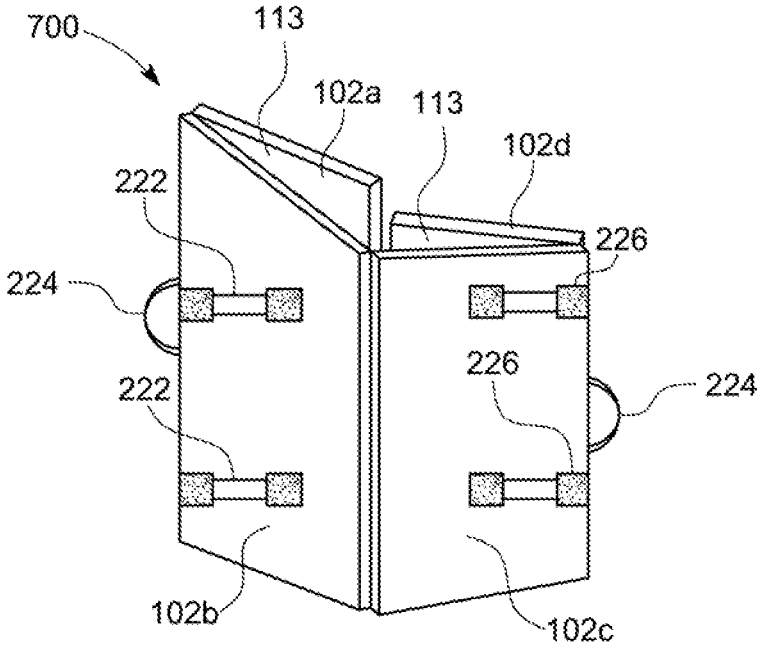
FIG. 7B shows an exemplary mobility mat in an intermediate folding position, according to an embodiment of the present disclosure.
Figure 7C:
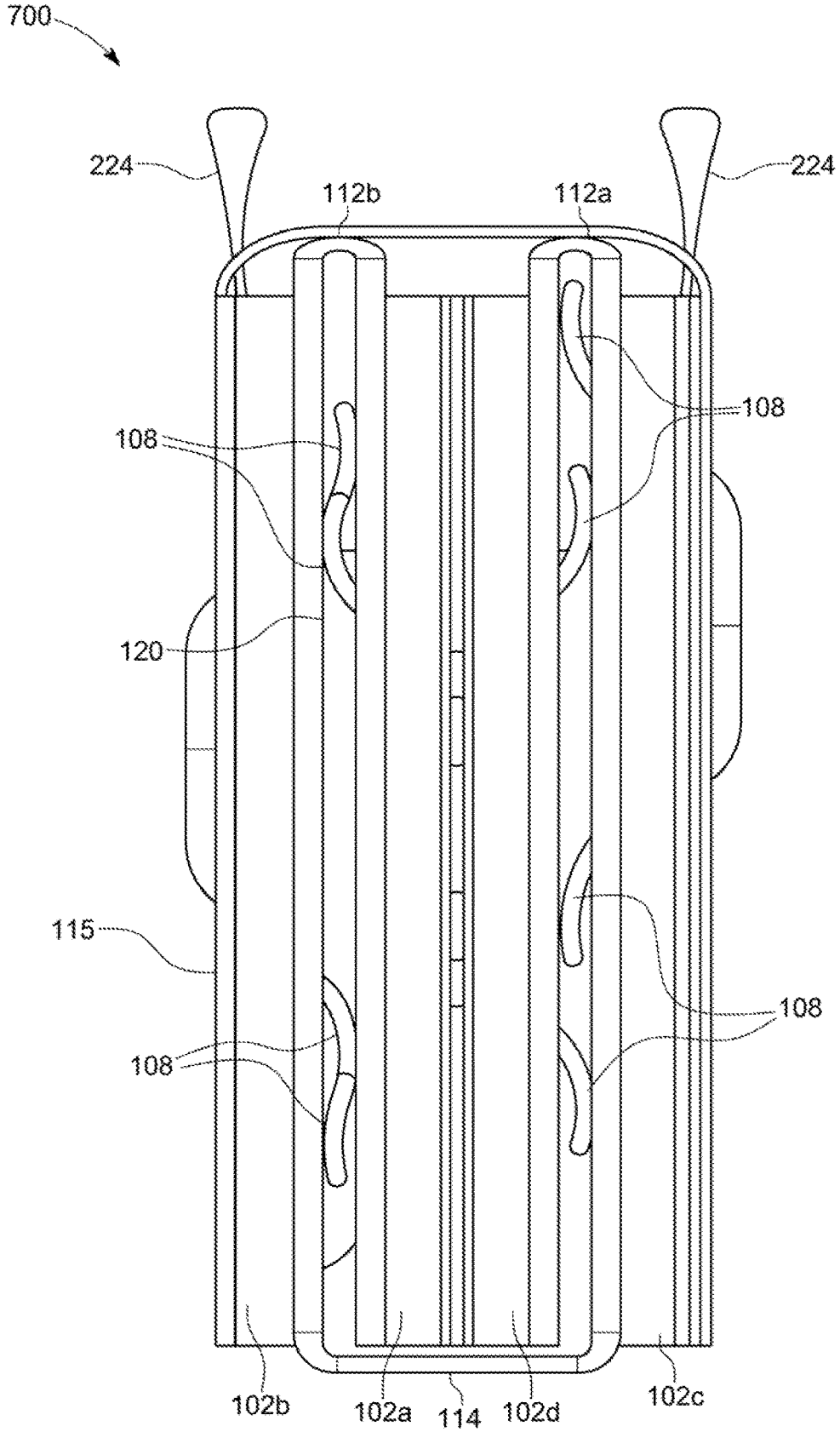
FIG. 7C shows a folded position of an exemplary mobility mat, according to an embodiment of the present disclosure.

FIGS. 7A-7C illustrate an exemplary mobility mat being folded into a folded position, according to an embodiment of the present disclosure. FIGS. 7A-7C show an exemplary system 700 with similarly numbered elements and corresponding functions to the elements of FIGS. 1-2B. For example, in FIG. 7A, the top and bottom segments 102*a* and 102*d* can be folded so that top surfaces 113 of segments 102*a* and 102*d* face top surfaces 113 of the second and third segments 102*b* and 102*c*. This folding can happen along respective connecting sections elements 112*a* and 112*b* (see FIG. 1), as described in more detail below. FIG. 7B shows a second folding step can occur along 114 such that bottom surfaces 114 of segments 102*a* and 102*d* face each other.

FIG. 7C illustrates the mobility mat 110 in a generally folded position. FIG. 7C demonstrates how the second and third segments 102*c* and 102*b* have been folded such that bottom surfaces 115 of the top and bottom segments 102*a* and 102*d* face and are generally flush with each other. This folding can be achieved due to the dimensions of the connecting segment 114 (see FIG. 1). Namely, the connecting segment 114 has a length L2 generally equal to about twice the depth D1 of a segment 102. FIG. 7C further demonstrates that the assistive features of the mobility mat 110 such as the hand holds 108 and the cushion 120 can be configured to fit neatly against each other while mobility mat 110 is in a folded configuration. Put another way, the assistive features do not interfere with one another, e.g., the tops of the assistive features do not contact one another, thereby reducing the bulk of the mobility mat 110. Additionally, when in the folded position of FIG. 7C, the handles 224 positioned on the bottom surface 115 of the mobility mat 110 are arranged such that a user can carry the mobility mat 110 via the handles 224.

FIGS. 7A-7B further show the first coupling elements 222 and second coupling elements 226. The coupling elements 222 and 226 can be configured to receive one another and secure mobility mat 110 in the folded position. For example, first coupling element 222 can be a female connector and second coupling element 226 can be a male connector. Second coupling element 226 can reach around segments 102*a* and 102*d* to connect with first coupling element 222 the mobility mat 110 is in the folded position.

Figure 8A:
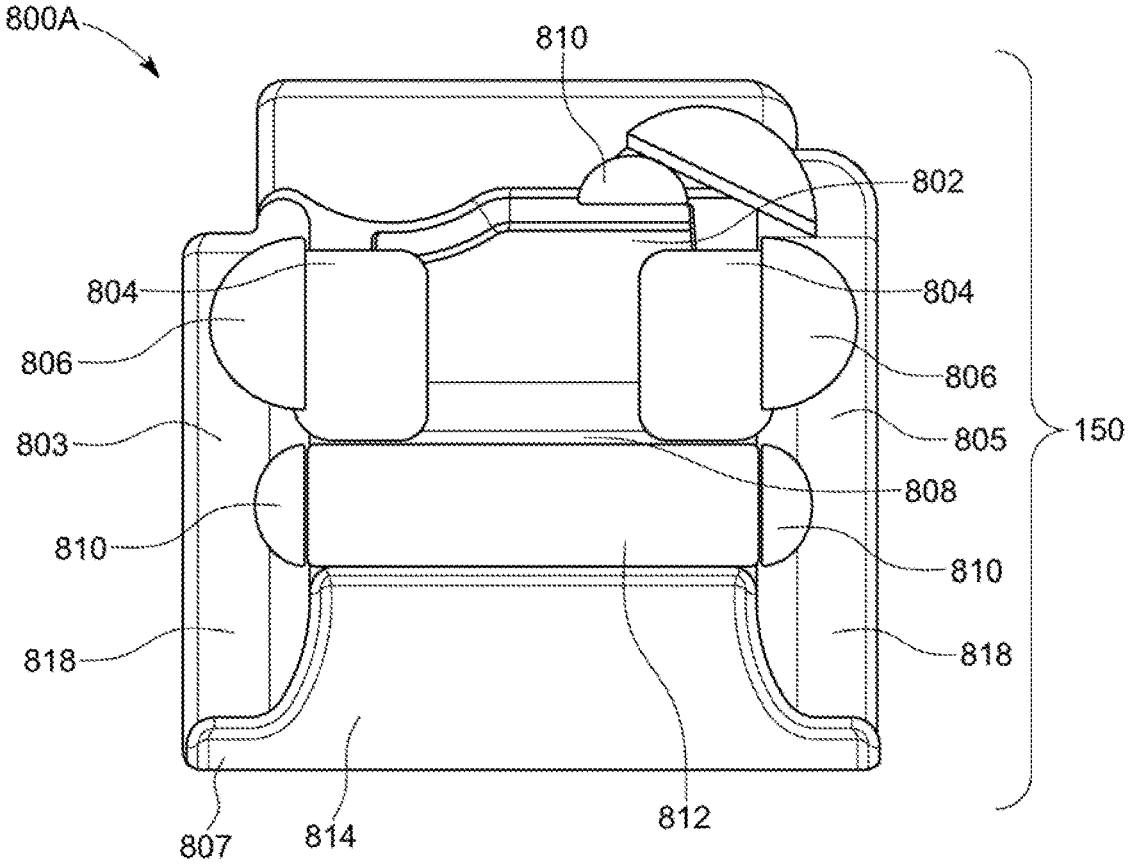
FIG. 8A shows a top perspective view of an exemplary mobility mat, according to an embodiment of the present disclosure.
Figure 8B:
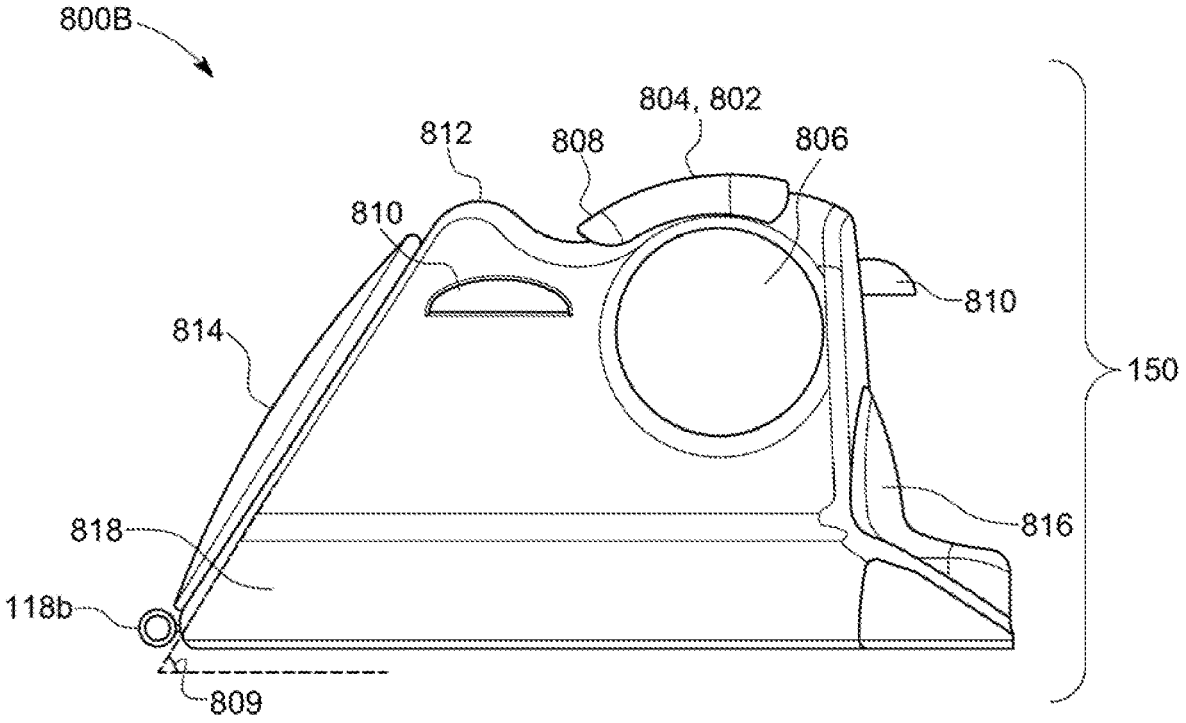
FIG. 8B shows a side perspective view of an exemplary mobility mat, according to an embodiment of the present disclosure.
Figure 8C:
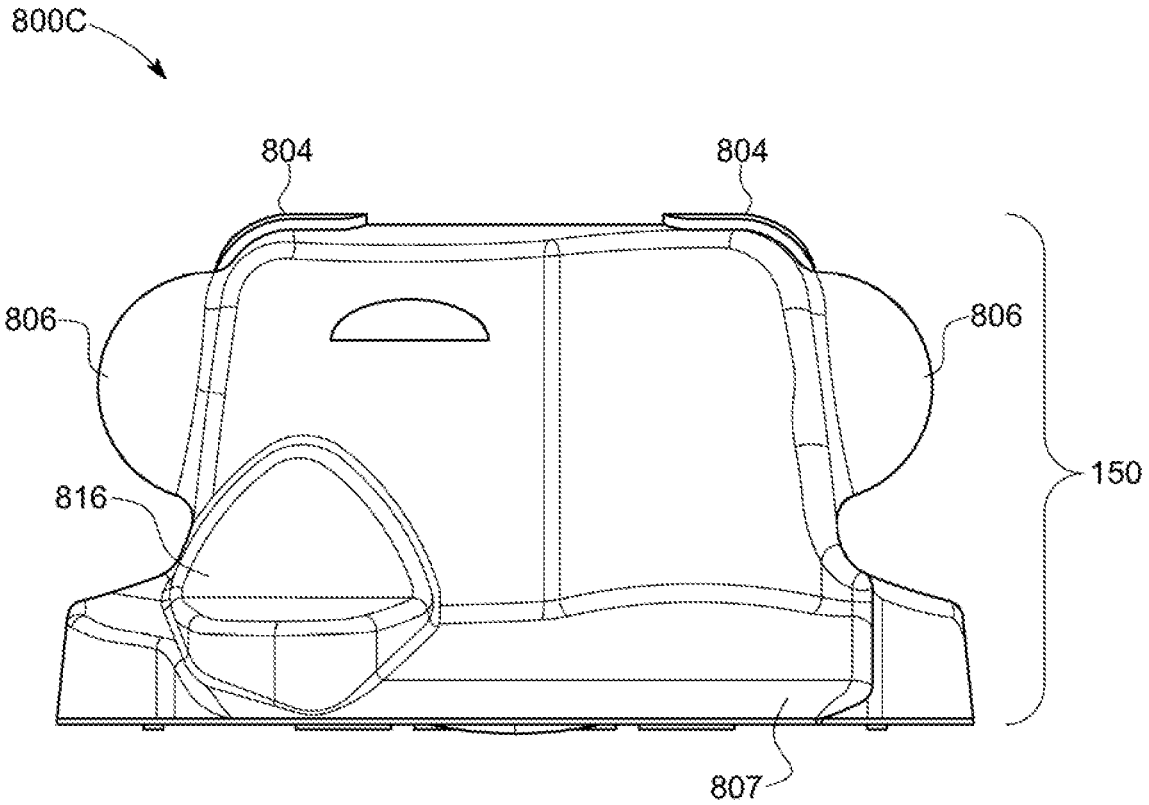
FIG. 8C shows a rear perspective view of an exemplary mobility mat, according to an embodiment of the present disclosure.
Figure 8D:
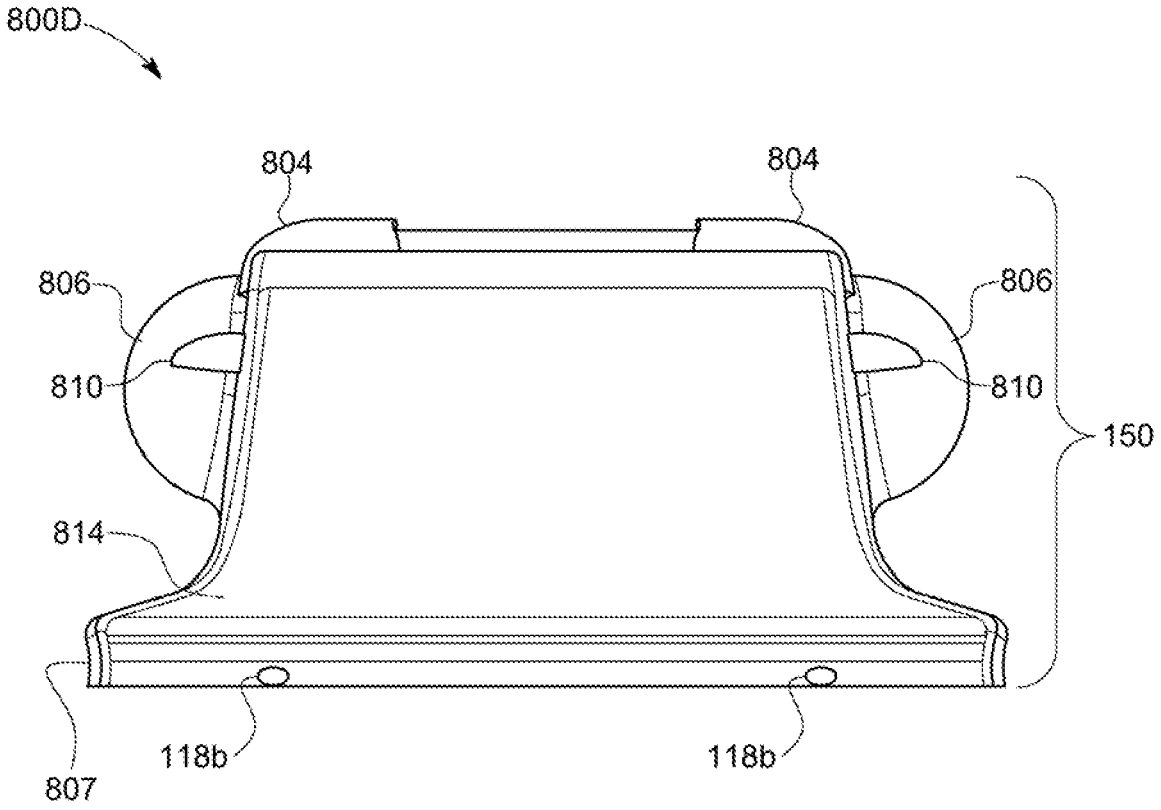
FIG. 8D shows a front perspective view of an exemplary orthopedic device, according to an embodiment of the present disclosure.

FIGS. 8A-8D show various perspective views of an exemplary orthopedic device 150, according to an embodiment of the present disclosure. FIG. 8A shows a view of a contoured side 800A, FIG. 8B shows a view of a side with support handles 800B, FIG. 8C is a rear-facing view of a side with a two-tiered ledge 800C, and FIG. 8D shows a front-facing view of an inclined side 800D. The orthopedic device 150 of FIGS. 8A-8D includes a first generally curved portion 802, padding elements 804, generally rounded hand holds 806, a valley portion 808, one or more generally flat hand grips 810, a second generally curved portion 812, an inclined portion 814, a two-tier triangular ledge 816, and one or more ledges 818.

Although not shown, orthopedic device 150 can further include a removable cover made of some type of fabric, leather, a synthetic material, any combinations thereof, or any other material. The cover can reduce any chance of blisters or skin abrasions of the user while using the device.

The contoured side 800A as shown in FIG. 8A, generally includes the first generally curved portion 802 and the second generally curved portion 812. The first generally curved portion 802 and the second generally curved portion 812 are generally parallel to one another and are separated from one another by a valley portion 808. The contoured side 800A can have hand grips 806 and padding elements 804 on either side of first generally curved portion 802. A user can lean on the padded elements 804 of the first generally curved portion 802 when performing exercises. The padding and the generally rounded nature of the region can reduce stress on a user's wrist joint as the user performs assisted pushups, planks, or other exercises. Padded elements 804 can comprise some type of fabric, leather, a synthetic material, any combinations thereof, or any other material.

The user can also lean on the generally rounded hand grips 806 for further joint relief and engage in contouring joint exercises FIG. 8A also shows the two generally opposing sides 803, 805 further discussed in FIG. 8B.

Referring now to FIG. 8B, the side face 800B shows how the second generally curved portion 812 can have a similar radius of curvature to the valley portion 808. For example, the radius of curvature can be similar to a radius of a user's forearm or a user's calf. Therefore, the valley portion 808 can readily receive a user's shin or forearm while performing various exercises. Additionally, the first curved portion 802 can have a radius of curvature substantially larger than a radius of curvature of either second curved portion 812 or valley portion 808. The different curvatures can allow a user to interact with the first and second rounded portions 802, 812 in a variety of grips.

FIG. 8B also shows exemplary placement locations for the generally rounded hand grips 806 and generally flat hand grips 810. The generally rounded hand grips 806 and generally flat hand grips 810 can be placed at the top of the side face 800B such that a user may achieve notable elevation when grasping and leaning on the grips 806 and 810. The generally rounded hand holds 806 can provide for roundly contouring joints, while the generally flat hand grips 810 can provide for precision rolls of a user's hands. The rounded support of hand holds 806 allows relaxed wrist positioning such that a user has freedom of movement of the shoulder and arm. Therefore, the generally rounded hand holds 806 allow soft joint positioning filer continuous chains of comfortable joint movement.

The generally flat hand grips 810 can provide upper and lower body mobility as the holds 810 may assist in positioning a user's wrist in a different orientation than if the user used a flat surface such as the ground or floor. A user may position his or her hand on the generally flat hand grips 810 in progressive chains of movement. Additionally, or alternatively, the generally flat hand grips 810 can be used as a foot ledge for a user's foot during stretching and other movements requiring additional support.

The two-tiered ledge side 800C, as shown in FIG. 8C, may include a two-tiered triangular ledge 816. The two-tiered triangular ledge can be large enough to receive a user's foot and can be positioned several inches above the ground. For example, a user can rest his or her foot and body weight on the two-tiered triangular ledge 816 while his or her leg is over the orthopedic device 150. The two-tiered triangular ledge 816 can provide toe extension stretches, a full plantar stretch, and full hand mobility.

FIG. 8C further shows exemplary proportions of generally rounded hand grips 806 and generally flat hand grips 810 in proportion to one another and in proportion to the orthopedic device 150. For example, flat hand grips 810 can be smaller in size to only receive the heel of a user's hand. Rounded hand grips 806 can be larger such that an entire hand can grasp the grip and rely on the grip with body weight. For example, finger strength can be more engaged in the rounded hand grips 806 than in the flat hand grips 810. Generally, there are no set sizes for grips 806 and 810, however both should desirably be sized to receive or accommodate a user's hand. Rounded hand grips 806 can be dome-shaped.

The inclined side 800D, as shown in FIG. 8D, can include an inclined portion 814 that may flare outwards at or near the base 807 of the orthopedic device 150. The inclined portion 814 can slope at an angle 809 of about 50 degrees, or any other angle between 0 degrees and 90 degrees. A slight slope around 50 degrees can assist in supporting a user while the user does, e.g., sit-ups. For example, a user would only have to perform the remaining 40 degrees sit-up movement, instead of having to raise his or her torso all 90 degrees from a position of laying flat on the mobility mat to a position of sitting straight upwards.

In some instances, the orthopedic device 150 can be housed and for stored within a cover (not shown). The cover can be removable, washable, and/or provide sweat absorbent or sweat wicking features.

Example Exercise Positions

Figure 9A:
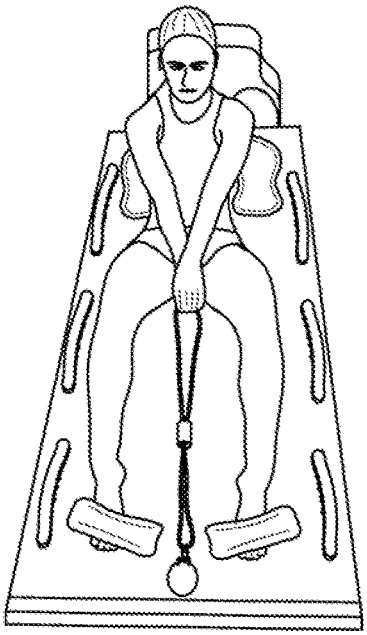
FIG. 9A shows an exemplary exercise position with a resistance band enabled by an exemplary exercise apparatus, according to an embodiment of the present disclosure.

FIGS. 9A-9D show examples of exercise positions enabled by an exemplary exercise apparatus, according to an embodiment of the present disclosure. FIG. 9A shows an exemplary position where a user seated on the mobility mat 110 described herein can anchor his or her feet via the foot holds 106 while using an exercise band attached to the receiving element 116. In other exercises of similar positions, a user could perform sit-ups, abdominal workouts, and/or stretches when sitting on the mobility mat 110 and anchoring his or her feet in foot holds 106.

Figure 9B:
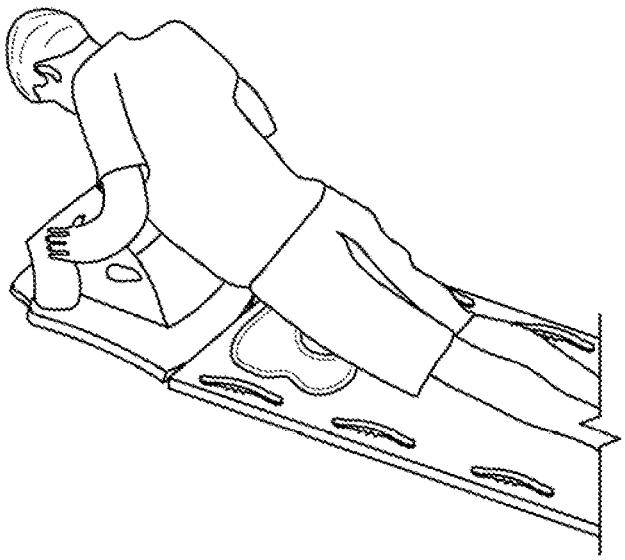
FIG. 9B shows an exemplary pushup position enabled by an exemplary exercise apparatus, according to an embodiment of the present disclosure.

FIG. 9B shows a user performing tricep pushups assisted by the orthopedic device 150 described herein. The orthopedic device 150 can reduce the gravitational force on a user's triceps due to the elevation of the apparatus. Therefore, orthopedic device 150 can assist a user with exercises that a user would be unable to perform without orthopedic device 150. The orthopedic device 150 may also assist a user with positioning his or her hands, thereby assisting to achieve the Maxillitlin effectiveness from the exercise.

Figure 9C:
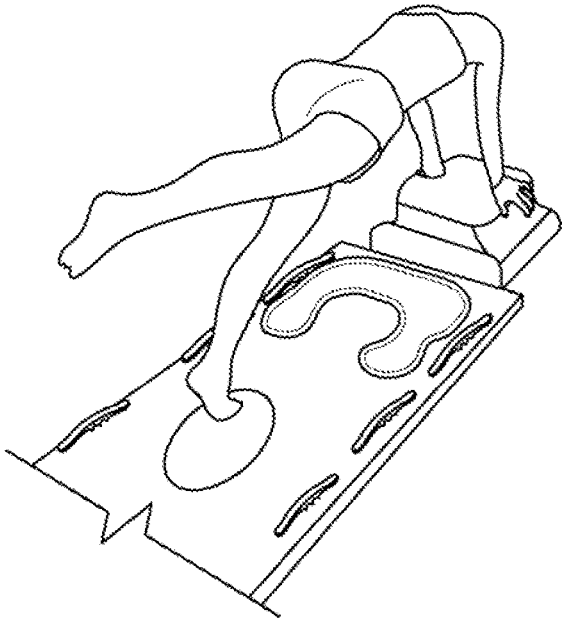
FIG. 9C shows an exemplary plank position enabled by an exemplary exercise apparatus, according to an embodiment of the present disclosure.

FIG. 9C shows a user performing stretching and conditioning exercises while grasping the padded portions 804 of first curved portion 802 of the orthopedic device 150. Such a position assists in reducing stress on a user's metacarpals and wrists while performing the exercises. Therefore, an exercise apparatus as provided for by the present disclosure, can assist in allowing a user to more effectively isolate and exercise a particular limb or muscle group while minimizing the risk of pain from another body area.

Figure 9D:
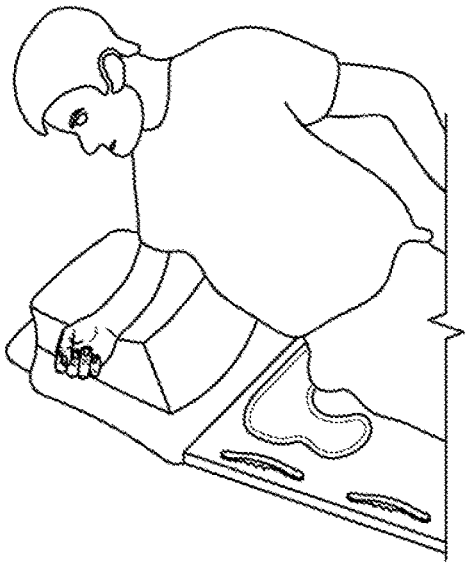
FIG. 9D shows an exemplary side plank position enabled by an exemplary exercise apparatus, according to an embodiment of the present disclosure.

FIG. 9D shows a user performing a side plank while placing his forearm into the valley portion 808 of the orthopedic device 150. The elevation of the orthopedic device 150 and curved nature of the valley portion 808 provides a comfortable mechanism for a user to lean on while performing exercises. Therefore, a user can more effectively concentrate and exercise his or her targeted area.

Embodiments of the present disclosure provide assistive features that can enable proper joint movement, strengthening and conditioning exercises, functional training, balance work, rehabilitative work across different stages of recovery, progressive positions, and many other exercise and rehabilitative functions as any person skilled in the art would understand. The present disclosure provides a device that allows users to exercise joint movement that they could not exercise without such assistive features. The progressive positioning, in particular, allows a user to exercise end-of-range joint movement and advance the periphery of the user's movement.

Therefore, the present disclosure provides an all-in-one exercise apparatus that can be used in a variety of different exercise positions for a variety of different joints movements and conditioning. The number of assistive features and the flexibility of each assistive feature to be used in many different orientations provides an exercise apparatus unparalleled in the conventional exercise market. Moreover, the present disclosure provides an exercise apparatus that assists users in performing exercises that they could not do on their own without an assistive feature. For example, some users could not do a pushup without a toot anchor or could not perform certain stretches without a hand hold.

While various examples of the present invention have been described above, it should be understood that they have been presented by way of example only, and not limitation, Numerous changes to the disclosed examples can be made in accordance with the disclosure herein without departing from the spirit or scope of the invention, Thus, the breadth and scope of the present invention should not be limited by any of the above-described examples. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular examples only and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. Furthermore, terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A mobility mat, comprising:

a plurality of segments, each of the plurality of segments including a top surface and a bottom surface, wherein the plurality of segments further comprises:

a first segment comprising a cushion coupled thereto and at least one hand hold, wherein the cushion is shaped in a hollowed semi-circular configuration to yield a base, a first extension generally extending from a first side of the base, and a second extension generally extending from a second side of the base, and wherein the cushion is contoured such that central regions of the base and end regions of the first extension and the second extension are higher than non-central regions of the base;

a second segment positioned generally opposite the first segment, the second segment comprising at least one hand hold and at least one foot hold; and at least one middle segment positioned between the first segment and the second segment, wherein the at least one middle segment comprises at least one hand hold.

2. The mobility mat of claim 1, wherein end portions of each of the hand holds are respectively coupled to the top surfaces, a generally central portion of each of the hand holds being respectively spaced a distance away from the top surfaces such that an aperture is formed between the generally central portions and the top surfaces, respectively.

3. The mobility mat of claim 1, wherein the mobility mat is further configured to fold along connections between the plurality of segments to yield a folded position.

4. The mobility mat of claim 3, further comprising coupling elements respectively on the bottom surfaces of two of the plurality of segments of the mobility mat, wherein the coupling elements are configured to secure the mobility mat in the folded position.

5. The mobility mat of claim 1, wherein the second segment further comprises a receiving element configured to receive a supplemental exercise tool.

6. The mobility mat of claim 1, wherein each of the plurality of segments is comprised o a plurality of layers, wherein at least on layer in the plurality of layers is comprised of a material with a honeycomb structure.

7. The mobility mat of claim 1, further comprising:

each segment in the plurality of segments has at least two hand holds;

the second segment has at least two foot holds;

a first handle on an exterior edge of the first segment;

a second handle on an exterior edge of the second segment;

adhesive elements respectively on the bottom surfaces of any two segments of the plurality of segments, the adhesive elements configured to secure the mobility mat in a folded position; and connections between each of the plurality of segments, the connections generally flat and thin to configure the mobility mat to fold along the connections to yield the folded position.

8. An orthopedic device comprising:

a first side, comprising an inclined portion;

a second side, comprising a two-tiered ledge;

opposing side portions bridging the first side and the second side, each of the opposing side portions including a generally rounded hand grip and a generally flat hand grip; and a contoured top side, wherein the contoured top side further comprises a first generally curved portion, a valley portion, and a second generally curved portion, the first and second generally curved portions being generally parallel to one another, and the first and second generally curved portions being separated by the valley portion.

9. The orthopedic device of claim 8, wherein the second generally curved portion and the valley portion have substantially similar radii of curvature.

10. The orthopedic device of claim 8, wherein a radius of curvature of the first generally curved portion is substantially larger than a radius of curvature of either the second generally curved portion or the valley portion.

11. The orthopedic device of claim 8, wherein the generally rounded hand grip is generally domed-shaped.

12. An exercise system comprising:

a mobility mat including a plurality of segments and at least one first connector, each of the plurality of segments including a top surface and a bottom surface, wherein the plurality of segments further comprises:

a first segment comprising a cushion coupled thereto and at least one hand hold, wherein the cushion is shaped in a hollowed semi-circular configuration to yield a base, a first extension generally extending from a first side of the base, and a second extension generally extending from a second side of the base, and wherein the cushion is contoured such that central regions of the base and end regions of the first extension and the second extension are higher than non-central regions of the base;

a second segment position generally opposite the first segment, the second segment comprising at least one hand hold and at least one foot hold; and at least one middle segment positioned between the first segment and the second segment, wherein the at least one middle segment comprises at least one hand hold; and an orthopedic device comprising a plurality of sides and at least one second connector, the plurality of sides further comprising:

a first side, comprising an inclined portion;

a second side comprising a two-tiered ledge;

opposing side portions bridging the first side and the second side, each of the opposing side portions including a generally rounded hand grip and a generally flat hand grip; and a contoured top side;

wherein the at least one second connector is configured to receive the at least one first connector.

* * * * *